US007370444B2

(12) United States Patent
Savoie

(10) Patent No.: US 7,370,444 B2
(45) Date of Patent: May 13, 2008

(54) ANTI-TWIST CLEAT RECEPTACLE

(75) Inventor: Armand J. Savoie, Gardner, MA (US)

(73) Assignee: Cleats LLC, Marlborough, MA (US)

( * ) Notice: Subject to any disclaimer, the term of this patent is extended or adjusted under 35 U.S.C. 154(b) by 141 days.

(21) Appl. No.: 11/311,446

(22) Filed: Dec. 19, 2005

(65) Prior Publication Data

US 2006/0112598 A1 Jun. 1, 2006

Related U.S. Application Data

(63) Continuation-in-part of application No. 11/176,428, filed on Jul. 7, 2005.

(60) Provisional application No. 60/586,475, filed on Jul. 8, 2004.

(51) Int. Cl.
*A43C 15/02* (2006.01)

(52) U.S. Cl. ..... 36/134; 36/127

(58) Field of Classification Search ..... 36/134, 36/67 D, 67 R, 67 A, 67 B, 67 C
See application file for complete search history.

(56) References Cited

U.S. PATENT DOCUMENTS 2,523,652 A * 9/1950 Dowd et al. ..... 36/59 R
3,133,363 A * 5/1964 Warmelle, Jr. et al. ..... 36/59 R
3,331,148 A * 7/1967 Hollister et al. ..... 36/67 A
3,623,244 A 11/1971 Williams
4,561,197 A * 12/1985 Misevich ..... 36/127
5,361,518 A * 11/1994 Sussmann et al. ..... 36/134
5,901,472 A 5/1999 Adam

FOREIGN PATENT DOCUMENTS

| | | |
|---|---|---|
| DE | 1715551 | 1/1956 |
| DE | 18 21 616 | 11/1960 |
| DE | 196 32 537 A1 | 3/1997 |
| EP | 0 360 202 | 9/1989 |
| FR | 2 615 075 | 11/1988 |
| GB | 673399 | 6/1952 |
| WO | WO 2006/010101 | 1/2006 |

OTHER PUBLICATIONS

International Search Report.

* cited by examiner

*Primary Examiner*—Ted Kavanaugh
(74) *Attorney, Agent, or Firm*—Bromberg & Sunstein LLP

(57) ABSTRACT

A cleat receptacle for footwear. The cleat receptacle includes a cleat-engaging structure surrounded by a flange. The flange includes portions that are sloped with respect a plane perpendicular to the axis of the cleat-engaging structure. The receptacle is molded into a shoe outsole. Outsole material adjacent to sloped portions of the flange resists twisting of the receptacle as cleats are inserted into or removed from the receptacle. Paddle projections may be attached to the flange to further resist twisting of the receptacle.

5 Claims, 3 Drawing Sheets

ANTI-TWIST CLEAT RECEPTACLE

This application is a continuation-in-part of U.S. patent application Ser. No. 11/176,428, entitled "Anti-Twist Cleat Receptacle", filed 07-07-2005, which claims priority from U.S. provisional patent application No. 60/586,475, filed Jul. 8, 2004, entitled "Anti-Twist Cleat Receptacle," each of which is incorporated herein by reference.

TECHNICAL FIELD

The present invention relates to traction cleat receptacles mounted on the bottom of footwear, in particular, athletic footwear.

BACKGROUND

Conventional traction gear for footwear use a large number of individual traction elements, such as cleats, that are attached to the outsole of a shoe. The typical golf shoe, for example, includes seven cleats that are individually attached to the shoe by screwing the cleat into the mated receiving receptacle in the bottom of the footwear. Progress has been made in recent years in reducing the effort needed to attach and to remove traction elements from footwear by reducing the rotations needed to attach each traction element. For example, U.S. Pat. No. 5,768,809 describes a quick-release Q-LOK™ traction element connector. When inserted into a receptacle, a Q-LOK™ connector can be securely attached to an outsole by rotating the cleat less than a third of a turn.

Cleats receptacles are typically molded into footwear outsoles. If a cleat installer continues to twist a cleat after the cleat is fully inserted into the receptacle, the receptacle may rotate with respect to the outsole. This rotation may render the shoe unusable since the cleat can then rotate as the shoe is worn and various torques are applied to the cleat by ground contact. In addition, the cleat cannot be easily removed from the receptacle. A cleat receptacle is therefore needed that provides superior resistance to twisting in an outsole as a cleat is installed, removed or twisted by ground contact during use.

SUMMARY OF THE INVENTION

In certain embodiments of the present invention, a cleat receptacle is provided that resists twisting when mounted in a shoe outsole. Such twisting can occur when a cleat is inserted into or removed from the receptacle. The receptacle includes a structure for engaging a cleat by inserting the cleat into the structure and rotating the cleat about the structure's axis. The receptacle includes a flange or a group of flanges connected to the cleat-engaging structure. The flange includes a portion that is substantially sloped with respect to a plane that is perpendicular to the cleat-engaging structure's axis. When twisted, the sloped portion of the flange presses against adjacent outsole material, resisting the twisting. The slope of the flange can range from at least about 5 degrees in certain embodiments of the invention to at least about 20 degrees in other embodiments of the invention.

In other embodiments of the invention, the receptacle flange may include a wave, i.e., the slope of the flange with respect to a plane that is perpendicular to the cleat-engaging structure's axis changes the sign of at least one component of the slope between at least two portions of the flange.

In certain embodiments of the invention, a receptacle flange may have a perimeter that is non-circular, to further resist twisting in the shoe outsole.

In another embodiment of the invention, paddle projections may be attached to the receptacle flange. The paddle projections may be tilted so that the faces of the paddle projections are not parallel to the direction of the cleat-engaging structure's axis. In some embodiments of the invention, the tilt of the paddle projections may differ for adjacent projections.

BRIEF DESCRIPTION OF THE DRAWINGS

The foregoing features of the invention will be more readily understood by reference to the following detailed description, taken with reference to the accompanying drawings, in which.

DETAILED DESCRIPTION OF SPECIFIC EMBODIMENTS

Definitions

As used in this description and the accompanying claims, the following terms shall have the meanings indicated, unless the context otherwise requires:

A "shoe" means any outer covering for a foot including, without limitation, athletic footwear, sandals, boots, and slippers.

In certain embodiments of the present invention, a cleat receptacle is provided that resists twisting when mounted in a shoe outsole. The receptacle includes a structure for engaging a cleat by inserting the cleat into the structure and rotating the cleat about the structure's axis. The receptacle includes a flange or a group of flanges connected to the cleat-engaging structure. The flange includes a portion that is substantially sloped with respect to a plane that is perpendicular to the cleat-engaging structure's axis. When twisted, the sloped portion of the flange presses against adjacent outsole material, resisting the twisting. The slope of the flange can range from at least about 5 degrees in certain embodiments of the invention to at least about 20 degrees in other embodiments of the invention.

Figure 1:
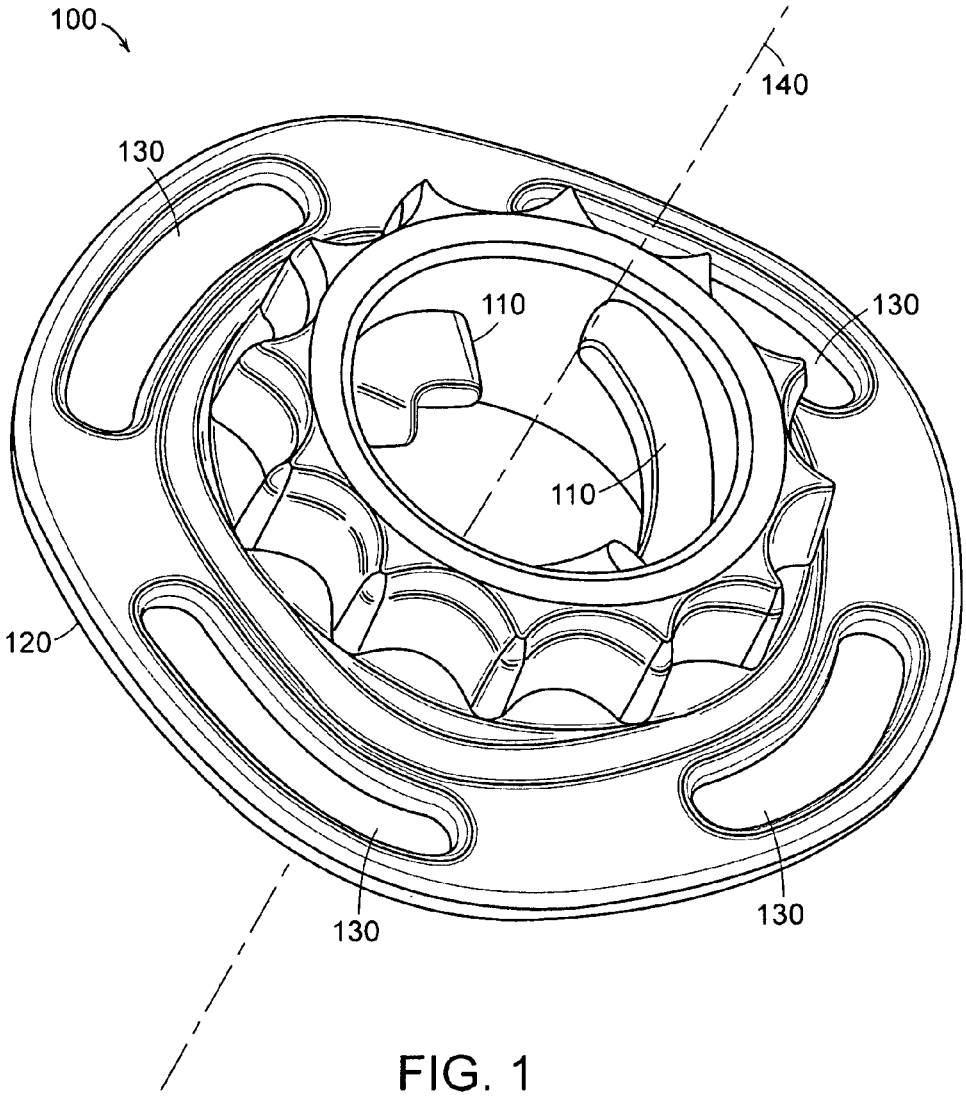
FIG. 1 shows a cleat receptacle for a shoe according to an embodiment of the invention.
Figure 2:
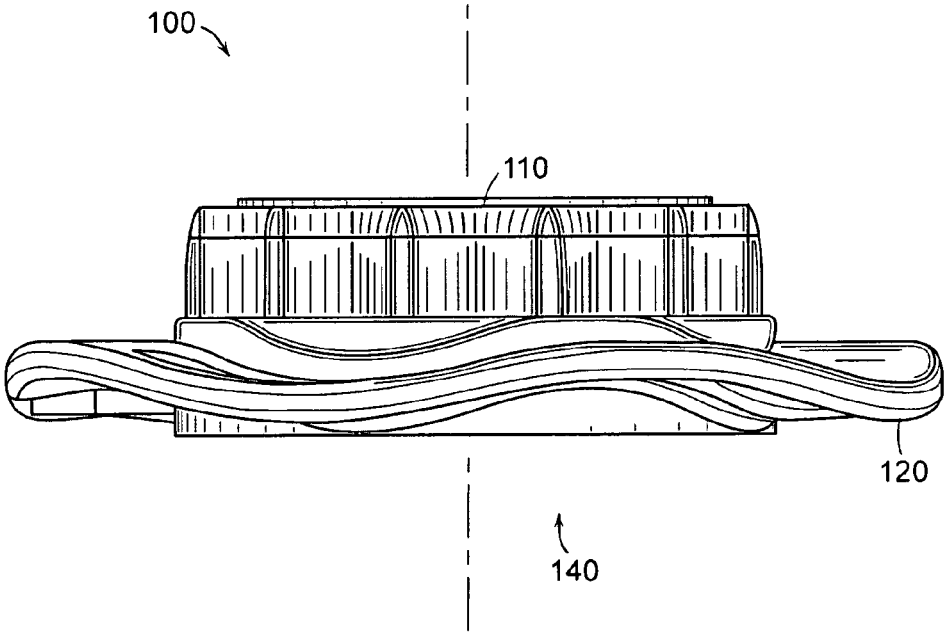
FIG. 2 shows a side view of the cleat receptacle of FIG. 1.

FIG. 1 shows a cleat receptacle 100 according to an embodiment of the present invention. A cleat-engaging structure 110 is provided at the center of the receptacle. The cleat-engaging structure defines an axis 140 about which the cleat is rotated when inserted or removed. A flange 120 surrounds the cleat-engaging structure 110. The flange 120 is formed so that at least a portion of the flange is substantially sloped with respect to any plane perpendicular to axis 140. When the receptacle 100 is molded into a shoe outsole and twisted, a portion of the shoe outsole adjacent to the sloped flange portion will exert pressure on the receptacle and resist twisting. In specific embodiments of the invention, the slope of the portion of the flange exceeds 5 degrees, 10 degrees, 15 degrees and 20 degrees respectively. In specific embodiments of the invention, the flange 120 can include slots 130 for mounting the receptacle to a shoe outsole. Mounting of the receptacle is by methods known in the art and may include forming sole material around the slots or by nailing the slots to the outsole and then forming material around the receptacle, including the flange. FIG. 2 shows a side view of the receptacle of FIG. 1.

In further embodiments of the invention, a flange 120 includes two sloped portions where the sign of at least one component of the slope changes between the portions. This embodiment includes a wave within the flange. In further embodiments of the invention, the wave within the flange may include changes in slope that are abrupt. For example, the flange may include one or more step transitions, where the slope abruptly changes over a short distance. These transitions may be followed by a reverse transition within a short distance on the flange—that is a step-up and then a step-down transition. Alternatively, the flange may include a set of "staircase" steps. A reverse transition may be provided that mirrors the first transition or has a different pattern of sloped regions. All such patterns of flange slope transitions are within the scope of the invention.

In further embodiments of the invention, in any of the preceding embodiments, the flange or flanges may be shaped so that the perimeter of the flange or flanges is non-circular. The non-circular shape of the flange causes outsole material to be molded into portions around the flange perimeter that will resist receptacle twisting as cleats are inserted into or removed from the receptacle.

In further embodiments of the invention, in any of the preceding embodiments, the flange or flanges may have a radius bend at their perimeter. Such a radius bend serves to reduce cutting of the outsole material as the receptacle starts to twist.

In other embodiments of the invention, in any of the preceding embodiments of the invention, one or more projections may be attached to the flange to further retard receptacle twisting. The projections may be parallel to the cleat-engaging structure's axis. Alternatively, each projection may be individually inclined with respect to the cleat-engaging structure's axis at any angle.

Figure 3A:
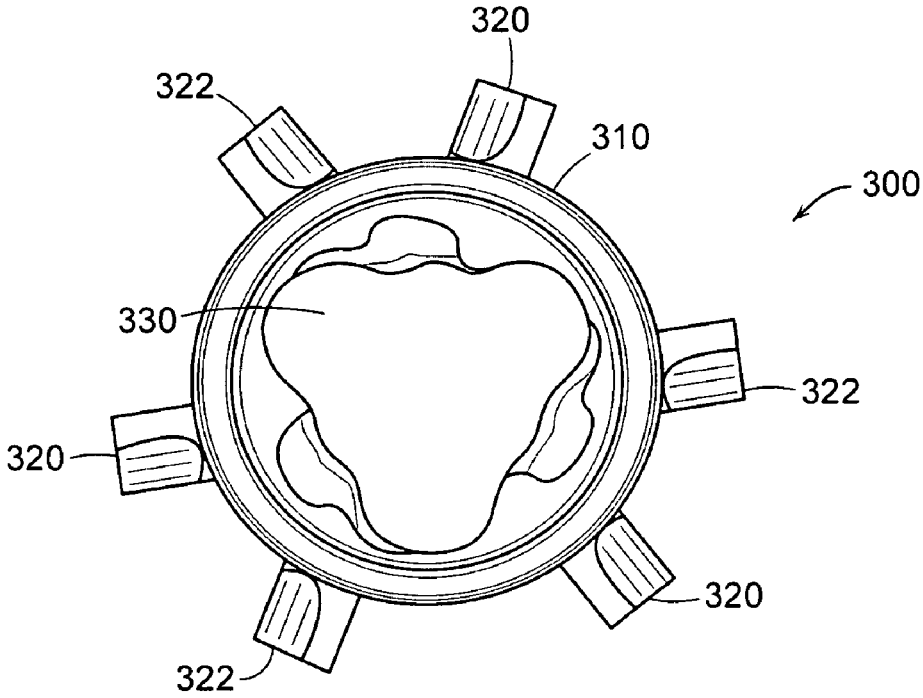
FIG. 3 shows another cleat receptacle according to an embodiment of the invention.
Figure 3B:
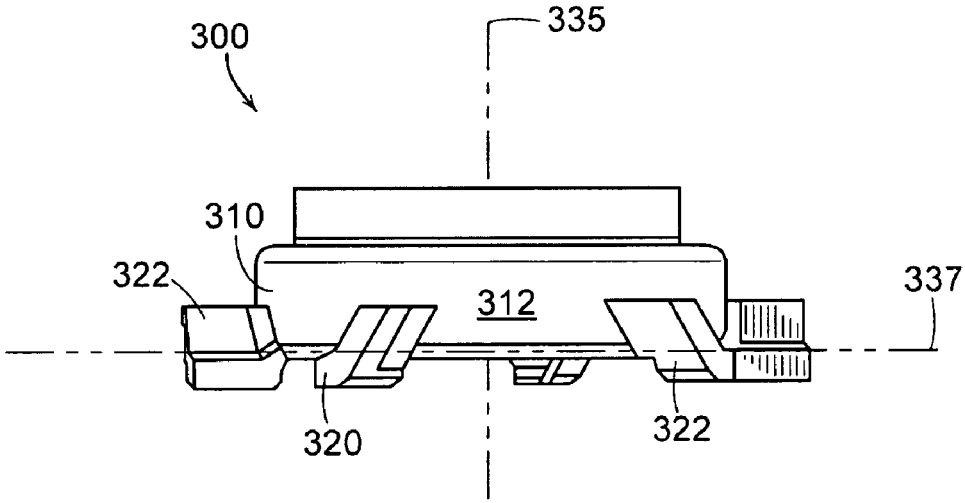

In another embodiment of the invention, an anti-twist cleat receptacle 300 is provided, as shown in FIG. 3. FIG. 3A shows a top-down plan view of the cleat receptacle 300. A cleat-engaging structure 330 is provided at the center of the receptacle. The cleat-engaging structure defines an axis 335 which is normal to the plane of FIG. 3A and centered on the cleat. The cleat is rotated about the cleat-engaging structure axis when inserted or removed. A flange 310 surrounds the cleat-engaging structure 330. The flange includes an "edge surface," which is defined as a flange surface such that the normal to the edge surface is substantially perpendicular to the cleat engaging structure axis. An edge surface 312 is shown in FIG. 3B. Paddle projections 320, 322 are connected to the edge surface of the flange. A "degree of tilt" of a paddle projection shall be the measure of the angle that the normal to the broadest face of the paddle projection makes to a "measurement" plane. The "measurement plane" shall be defined as the plane that contains the cleat-engaging structure axis and a line perpendicular to the cleat-engaging structure axis such that the line contains the centroid of the broadest face of the paddle projection. FIG. 3B shows a cross section of the measurement plane 337 for paddle projection 320. At least one paddle projection in this embodiment of the invention has a degree of tilt substantially different from 0 degrees. In a preferred embodiment of the invention, the degree of tilt is approximately 45 degrees for at least one paddle projection. In other embodiments, the degree of tilt can range from 20 degrees to 70 degrees. The degree of tilt may vary among the paddle projections on a cleat. In one embodiment of the invention, adjacent paddle projections differ in degree of tilt while next-nearest-neighbor paddle projections have the same degree of tilt. Note that the broadest faces of paddle projections need not be planar, but may incorporate one or more bends.

In another embodiment of the invention, an anti-twist receptacle 100 is provided as shown in FIGS. 1 and 2. A "degree of tilt" for a flange portion shall be the measure of the angle that the normal to the portion makes to a "measurement" plane. The "measurement plane" shall be defined as the plane that contains the cleat-engaging structure axis and a line perpendicular to the cleat-engaging structure axis such that the line contains the centroid of the flange portion. The degree of tilt of a portions of the flange 120 of the may range in this embodiment from 0 degrees to 90 degrees or any tilt angle in between. For example, the degree of tilt for portions may range from about 5 degrees to about 30 degrees. Alternatively, the degree of tilt for portions of the flange may range from about 10 degrees to about 20 degrees. In specific embodiments of the invention, the degree of tilt for portions of the flange may extend from about 10 degrees to about 15 degrees. In other embodiment of the invention, the degree of tilt may extend from about 5 degrees to about 10 degrees.

The cleat-engaging structure of the receptacle may be of any shape that is suitable to mate with a corresponding cleat. The attachment structure may conform to the Q-LOK™ system sold by MacNeill Engineering, Inc. (as described in U.S. Pat. Nos. 5,768,809, 6,151,805, 6,108,944, and 6,463,618), to the TRI-LOK™ system also sold by MacNeill Engineering, Inc., to the Fast Twist™ system sold by Softspikes, Inc. (as described in U.S. Pat. Nos. 5,123,184, 5,524,367, 5,974,700 and 6,272,774), to a circumferentially threaded structure or to any other structure that may be attached to a receptacle. Each of the aforementioned patents is incorporated herein by reference.

While preferred embodiments have been described in which a receptacle for traction elements, such as cleats, can be attached to a shoe outsole, the use of such receptacles is not limited to attaching traction elements to shoes, but may be generally employed as a twist-resistant receptacle for rotatably attachable elements in other applications which require the attachment of one mechanical structure to another. Similarly, it is of course apparent that the present invention is not limited to the detailed description set forth above. Various changes and modifications of this invention as described will be apparent to those skilled in the art without departing from the spirit and scope of this invention as defined in the appended claims.

What is claimed is:

1. A cleat receptacle comprising:

a. a cleat-engaging structure, the structure characterized by an axis about which cleats are rotated for insertion into or removal from the receptacle; and b. a shoe attachment structure surrounding the cleat-engaging structure, the shoe attachment structure including a flange for attachment to an outsole of the shoe, the flange including an edge surface, the edge surface a surface of the flange such that the normal to the edge surface is substantially perpendicular to the cleat engaging structure axis, the flange further including at least one paddle projection attached at a paddle projection edge to the edge surface such that the degree of tilt of the paddle projection is in the range from approximately 20 degrees to 70 degrees, where the degree of tilt of the paddle projection is the measure of the angle that the normal to the broadest face of the paddle projection makes to a measurement plane and where the measurement plane is a plane that contains the cleat-engaging structure axis and a line perpendicular to the cleat-engaging structure axis such that the line contains the centroid of the broadest face of the paddle projection.

2. A receptacle according to claim 1, wherein the at least one paddle projection includes a plurality of paddle projections.

3. A receptacle according to claim 2, wherein the plurality of paddle projection includes at least two adjacent paddles, whose degree of tilt differs.

4. A receptacle according to claim 2, wherein the plurality of paddle projection includes at least two adjacent paddle projections wherein the degree of tilt differs and at least two next nearest neighbor paddle projections with the same degree of tilt.

5. A shoe outsole assembly, comprising:

a. an outsole; and b. a receptacle including:

i a cleat-engaging structure, the structure characterized by an axis about which cleats are rotated for insertion into or removal from the receptacle; and ii a shoe attachment structure surrounding the cleat-engaging structure, the shoe attachment structure including a flange for attachment to the outsole of the shoe, the flange including an edge surface, the edge surface a surface of the flange such that the normal to the edge surface is substantially perpendicular to the cleat engaging structure axis, the flange further including at least one paddle projection attached at a paddle projection edge to the edge surface such that the degree of tilt of the paddle projection is in the range from approximately 20 degrees to 70 degrees, where the degree of tilt of the paddle projection is the measure of the angle that the normal to the broadest face of the paddle projection makes to a measurement plane and where the measurement plane is a plane that contains the cleat-engaging structure axis and a line perpendicular to the cleat-engaging structure axis such that the line contains the centroid of the broadest face of the paddle projection.

* * * * *